US009897329B2

(12) United States Patent
Sosso et al.

(10) Patent No.: US 9,897,329 B2
(45) Date of Patent: Feb. 20, 2018

(54) COOKTOP WITH DOWNDRAFT VENTILATOR

(75) Inventors: Peter F. Sosso, Hustisford, WI (US); John J. Huber, Delafield, WI (US); Christopher R. Irgens, Brookfield, WI (US); Gerhart S. Langenbach, Oconomowoc, WI (US)

(73) Assignee: Western Industries, Inc., Watertown, WI (US)

( * ) Notice: Subject to any disclaimer, the term of this patent is extended or adjusted under 35 U.S.C. 154(b) by 1577 days.

(21) Appl. No.: 13/491,767

(22) Filed: Jun. 8, 2012

(65) Prior Publication Data

US 2013/0327315 A1 Dec. 12, 2013

(51) Int. Cl.
*F24C 15/20* (2006.01)

(52) U.S. Cl.
CPC ..... *F24C 15/2042* (2013.01); *F24C 15/20* (2013.01)

(58) Field of Classification Search
CPC .... F24C 15/20; F24C 15/2042; F24C 15/205; F24C 15/2035
USPC ..... 126/299 D, 299 R
See application file for complete search history.

(56) References Cited

U.S. PATENT DOCUMENTS 3,367,320 A * 2/1968 Field ..... F24C 15/2042 126/300
3,474,724 A * 10/1969 Jenn ..... A47J 37/0676 126/299 R
3,587,555 A * 6/1971 Cerola ..... F24C 15/18 126/1 R
3,797,375 A 3/1974 Cerola
4,013,859 A 3/1977 Peters, Jr.
4,100,964 A 7/1978 Gorechev et al.
4,114,009 A 9/1978 Kiuchi et al.
4,149,217 A 4/1979 Tucker
4,169,222 A 9/1979 Tucker
4,191,875 A 4/1980 Cunningham
4,206,336 A 6/1980 Cunningham
4,308,443 A 12/1981 Tucker et al.
4,396,818 A 8/1983 Kominami et al.
4,415,788 A 11/1983 Field
4,431,892 A 2/1984 White
4,446,350 A 5/1984 Mizukawa et al.
4,446,849 A 5/1984 McFarland
4,447,691 A 5/1984 Mizukawa et al.
4,453,067 A 6/1984 Karklys et al.
4,453,068 A 6/1984 Tucker et al.
4,490,596 A 12/1984 Hirai et al.
4,501,260 A 2/1985 Grace
4,511,781 A 4/1985 Tucker et al.
4,549,052 A 10/1985 Simon
(Continued)

OTHER PUBLICATIONS

Page from Sears website www.sears.com/download/misc/kMInduct.pdf entitled *Designed for the Everyday Chef*, USA, Jan. 12, 2006.

(Continued)

*Primary Examiner* — Avinash Savani
*Assistant Examiner* — Aaron Heyamoto
(74) *Attorney, Agent, or Firm* — Boyle Fredrickson, S.C.

(57) ABSTRACT

A cooktop is provided that has a downdraft ventilator with a seal arrangement that may include a plenum seal and a vent grate seal. The plenum and vent grate seals may be arranged at interconnections of a plenum, a panel of the cooktop, and a vent grate to provide a layered and substantially airtight interconnection between such components.

22 Claims, 13 Drawing Sheets

(56) References Cited

U.S. PATENT DOCUMENTS

| | | | | |
|---|---|---|---|---|
| 4,562,827 | A | 1/1986 | Cerola | |
| 4,603,684 | A | 8/1986 | Kazuo et al. | |
| 4,686,340 | A | 8/1987 | Fukasawa | |
| 4,701,588 | A | 10/1987 | Fukasawa | |
| 4,736,729 | A | 4/1988 | Beach | |
| 4,750,470 | A | 6/1988 | Beach et al. | |
| 4,757,177 | A | 7/1988 | Suzuki et al. | |
| 4,766,880 | A | 8/1988 | von Blanquet | |
| 4,784,114 | A | 11/1988 | Muckler et al. | |
| 4,810,847 | A | 3/1989 | Ito | |
| 4,833,288 | A | 5/1989 | Poumey | |
| 4,846,146 | A | 7/1989 | Tucker et al. | |
| 4,886,046 | A | 12/1989 | Welch | |
| 4,887,587 | A | 12/1989 | Deutsch | |
| 4,899,028 | A * | 2/1990 | Arai | H05B 6/1263 126/21 A |
| 4,908,489 | A | 5/1990 | Panecki et al. | |
| 4,934,337 | A | 6/1990 | Falk | |
| 4,945,891 | A | 8/1990 | Cecil | |
| 4,951,646 | A | 8/1990 | Diekmann et al. | |
| 5,000,160 | A | 3/1991 | Dunlop et al. | |
| 5,001,970 | A | 3/1991 | Graver | |
| 5,010,223 | A | 4/1991 | Kim | |
| 5,062,410 | A | 11/1991 | Sarnosky et al. | |
| 5,111,014 | A | 5/1992 | Tanaka et al. | |
| D327,538 | S | 6/1992 | Falk et al. | |
| 5,119,802 | A | 6/1992 | Cherry et al. | |
| 5,158,068 | A | 10/1992 | Pickering | |
| 5,190,026 | A | 3/1993 | Doty | |
| 5,208,217 | A | 5/1993 | Katsoyannis | |
| 5,209,217 | A | 5/1993 | Beach et al. | |
| 5,213,091 | A | 5/1993 | Beach | |
| 5,376,775 | A | 12/1994 | Lee | |
| 5,428,207 | A | 6/1995 | Essig et al. | |
| 5,430,273 | A | 7/1995 | Bogdanski et al. | |
| 5,446,268 | A | 8/1995 | Chen | |
| 5,572,205 | A | 11/1996 | Caldwell et al. | |
| 5,900,175 | A | 5/1999 | Kicherer et al. | |
| 6,018,885 | A * | 2/2000 | Hill | D06F 58/10 34/202 |
| 6,198,080 | B1 | 3/2001 | Rice et al. | |
| 6,236,024 | B1 | 5/2001 | Gotz et al. | |
| 6,316,753 | B2 | 11/2001 | Clothier et al. | |
| 6,320,169 | B1 | 11/2001 | Clothier | |
| 6,444,958 | B1 | 9/2002 | Campbell | |
| 6,528,770 | B1 | 3/2003 | Akel et al. | |
| 6,528,772 | B1 | 3/2003 | Graves et al. | |
| 6,555,794 | B2 | 4/2003 | Leutner et al. | |
| 6,573,483 | B1 * | 6/2003 | DeCobert | A47J 27/62 219/432 |
| 6,600,139 | B2 | 7/2003 | Perschl et al. | |
| 6,630,650 | B2 | 10/2003 | Bassill et al. | |
| 6,639,190 | B2 | 10/2003 | Lerner | |
| 6,660,980 | B2 | 12/2003 | Nagata et al. | |
| 6,660,981 | B2 | 12/2003 | Ogata et al. | |
| 6,737,617 | B1 | 5/2004 | Daum et al. | |
| 6,770,857 | B2 | 8/2004 | Hirota et al. | |
| 6,821,628 | B2 | 11/2004 | Schultheis et al. | |
| 6,828,530 | B2 | 12/2004 | Boegel et al. | |
| 6,956,188 | B2 | 10/2005 | De Rooij et al. | |
| 7,049,552 | B2 | 5/2006 | Arntz et al. | |
| 7,049,563 | B2 | 5/2006 | Keishima et al. | |
| 7,081,603 | B2 | 7/2006 | Hoh et al. | |
| 7,102,109 | B2 | 9/2006 | Niiyama et al. | |
| 7,687,748 | B2 * | 3/2010 | Gagas | H05B 6/1263 126/21 A |
| 7,874,287 | B1 * | 1/2011 | Freden | F23L 1/00 110/182 |

OTHER PUBLICATIONS

*Research on Required Exhaust Flow Rate in Commercial Kitchens in the Case of Gas-Fired and Induction-Heating Cooking Equipment*, OSAKAGAS Technical Sheet, website www.osakagas.co.jp/rd/sheet/061e.htm, Japan.

*Induction Cooktops*, Australian Consumers' Association website www.choice.com.au, Australia.

*The Induction Hob Class Induction Technical Training*, Brandt Customer Services Formation CU3-Induction-002UK-02/03, ElcoBrandt training manual, France

*10-Bit Rotary Encoder IC Supplants Optical Encoder*, Electronic Products 29th Annual Product of the Year Awards, Jan. 2005, US.

Flexpoint Flexible Sensor Systems Inc., Multi-Purpose Bend Sensors® product specification, US.

* cited by examiner

COOKTOP WITH DOWNDRAFT VENTILATOR

FIELD OF THE INVENTION

The invention relates generally to ventilators for cooktops and, in particular, to downdraft ventilators.

BACKGROUND OF THE INVENTION

Systems for exhausting cooking fumes that are created during cooking procedures using cooktops are known. Overhead ventilation hoods are commonly used in both commercial and residential kitchens. Some homeowners do not like how overhead ventilation hoods look. Some installation locations of cooktops, such as separate island counter or end peninsular counter locations, can make mounting of overhead ventilation hoods difficult.

Flush or fixed surface-mounted ventilators have been used in situations in which overhead ventilation hoods are not desired. Such fixed surface-mounted ventilators tend to draw air transversely across the cooktop, which may draw cool ambient air across the food being cooked. To remedy this, telescoping downdraft ventilators have been provided. Telescoping downdraft ventilators have lessened the issues of drawing cool ambient air across food because they have inlets that draw air at a location that is vertically spaced above the cooking surface. This allows the telescoping downdraft ventilators to draw cooking fumes upwardly away from the food being cooked instead of drawing ambient air transversely across the cooking surface.

However, telescoping downdraft ventilators are often complex and expensive. Telescoping downdraft ventilators include numerous moving parts that may require maintenance over time.

SUMMARY OF THE INVENTION

The present inventors have recognized that relatively high-powered fans can be useful for fixed surface-mounted downdraft ventilators in cooktops. Using high-powered fans for fixed surface-mounted downdraft ventilators allows air to be drawn from higher above the cooking surface, instead of across the cooking surface which may draw cool ambient air across the food. The present inventors have further recognized that air leaks may occur in ventilator systems at joints defined between components at a cooktop panel. One such joint is where a cooktop panel and an underlying plenum connect to each other. Another such joint is where a cooktop panel and an overlying vent grill connect to each other. The present inventors have realized that assembly fit-up between cooktop panel and plenums and/or vent grills can be difficult to do consistently and/or accurately. That is because there can be relatively large variations between dimensions and flatness of cooktop panels because such panels are formed by punch-pressing and remain somewhat flexible after they are formed. Such variations in flatness and flexibility of the cooktop panels make such components difficult to form airtight seals against. The present inventors have further recognized that in gas cooktops, air leaks in fixed surface-mounted downdraft ventilators can detrimentally influence flame patterns from the gas burners. This may be due to ancillary airflows being created near the cooking surface that flow into the leak locations. Such ancillary airflows may otherwise compromise the integrity of the flame(s). Such issues can be worsened by using relatively high-powered fans in ventilation systems. Therefore, the present invention contemplates a cooktop and/or methods of assembling or installing cooktops that address these and other inventor-identified problems and drawbacks of the prior art.

Thus, in accordance with an aspect of the invention, a cooktop is provided that has an interconnected panel, plenum, and vent grate that are arranged in a layered and sealed configuration that is substantially airtight. The cooktop may be a gas cooktop. The gas cooktop may include a panel for supporting multiple gas burners and that has an upper surface and an opposing lower surface. The panel may have a vent opening that extends through the panel. A vent grate extends away from the upper surface of the panel. The vent grate is aligned with the vent opening so that cooking fumes that are created during a cooking process can be directed through the vent grate and the vent opening. This is done to exhaust the cooking fumes away from the panel. The vent grate includes an upper wall having openings through which the cooking fumes can flow. The vent grate also includes a side wall that extends downwardly from the vent grate upper wall. A plenum extends away from the lower surface of the panel. The plenum is aligned with the vent opening. In this way, the cooking fumes that are draw through the vent grate and vent opening are directed through the plenum for exhausting out of the system. A seal arrangement is provided between the panel and the vent grate and the panel and the plenum. This allows the upper and lower surfaces of the panel to be sealed against the vent grate and plenum, respectively. The seal arrangement between the panel and the vent grate also may include a retention tab that is fastened to an embossed area of the plenum, ensuring a precise location of the seal.

In accordance with another aspect of the invention, the seal arrangement includes a plenum seal and a vent seal.

In accordance with another aspect of the invention, the plenum includes a flange that extends outwardly from an upper end thereof. The plenum seal is substantially flat and is sandwiched between the flange of the plenum and the lower surface of the panel. Multiple fasteners extend between and draw the flange of the plenum and the panel toward each other. This compresses the plenum seal between the flange of the plenum and the lower surface of the panel.

In accordance with another aspect of the invention, the panel defines a main portion and a raised shelf that extends about the vent opening. The raised shelf includes an edge that defines the vent perimeter. The raised shelf of the panel may include an angled wall that extends angularly from the main portion of the panel and an upper wall that extends from the angled wall of the raised shelf. The edge of the raised shelf may be defined at an end of the upper wall. The upper wall of the raised shelf may be generally parallel to the main portion of the panel.

In accordance with another aspect of the invention, the vent seal may include an inner collar that extends downwardly through the vent opening in a direction that is generally parallel to the plenum. The inner collar of the vent seal may extend downwardly beyond the remainder of the vent seal. The inner collar of the vent seal may be nested inside of an upper portion of the plenum. A rib may extend outwardly from the inner collar of the vent seal in a direction that faces toward an outer perimeter of the panel. The rib may define a first rib upon the inner collar and a second rib may be provided that extends from the inner collar in a direction that faces toward the outer perimeter of the panel. The first and second ribs may be parallel to and spaced from each other along a length of the inner collar.

In accordance with another aspect of the invention, a portion of the panel through which the vent opening extends is held within a space that is between the rib of the vent seal and an inner segment of an upper wall of the vent seal. Such portion of the panel may be the raised shelf that extends about the vent opening.

In accordance with another aspect of the invention, the vent seal may include an upper wall that extends generally orthogonally away from the vent opening. The vent grate may engage the upper wall of the vent seal. The upper wall of the vent seal may include an inner segment that is relatively nearer to the vent opening and an outer segment that is relatively further from the vent opening. The outer segment of the vent seal upper wall may be elevated with respect to the inner segment of the vent seal upper wall. The vent seal upper wall may include an angled segment that connects the inner and outer segments of the vent seal upper wall.

In accordance with another aspect of the invention, the vent seal further includes a side wall that extends generally orthogonally, for example, generally vertically, between the vent seal upper wall and the panel. The vent seal side wall may hold the vent seal upper wall in a position that is spaced from the upper surface of the panel. An engagement of the vent grate side wall and vent seal upper wall may push or bend the vent seal upper wall relatively closer to the upper surface of the panel. In this way, the vent seal upper wall may define two positions or heights with respect to the panel, depending on whether or not the vent seal upper wall is being engaged by the vent grate. A first height with respect to the upper surface of the panel may be defined when the vent grate is removed from the gas cooktop, whereby the vent grate does not engage the vent seal. A second height with respect to the upper surface of the panel that is shorter that the first height may be defined when the vent grate is mounted to the gas cooktop, whereby the vent grate engages the vent seal.

In accordance with another aspect of the invention, the vent grate may include a side wall that engages the upper wall of the vent seal and a lower wall that extends from the vent grate side wall and outwardly beyond the vent seal. The vent grate lower wall may extend angularly downwardly and outwardly from an outer surface of the vent grate side wall.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings illustrate the best mode currently contemplated of practicing the present invention.

In the drawings.

Figure 1:
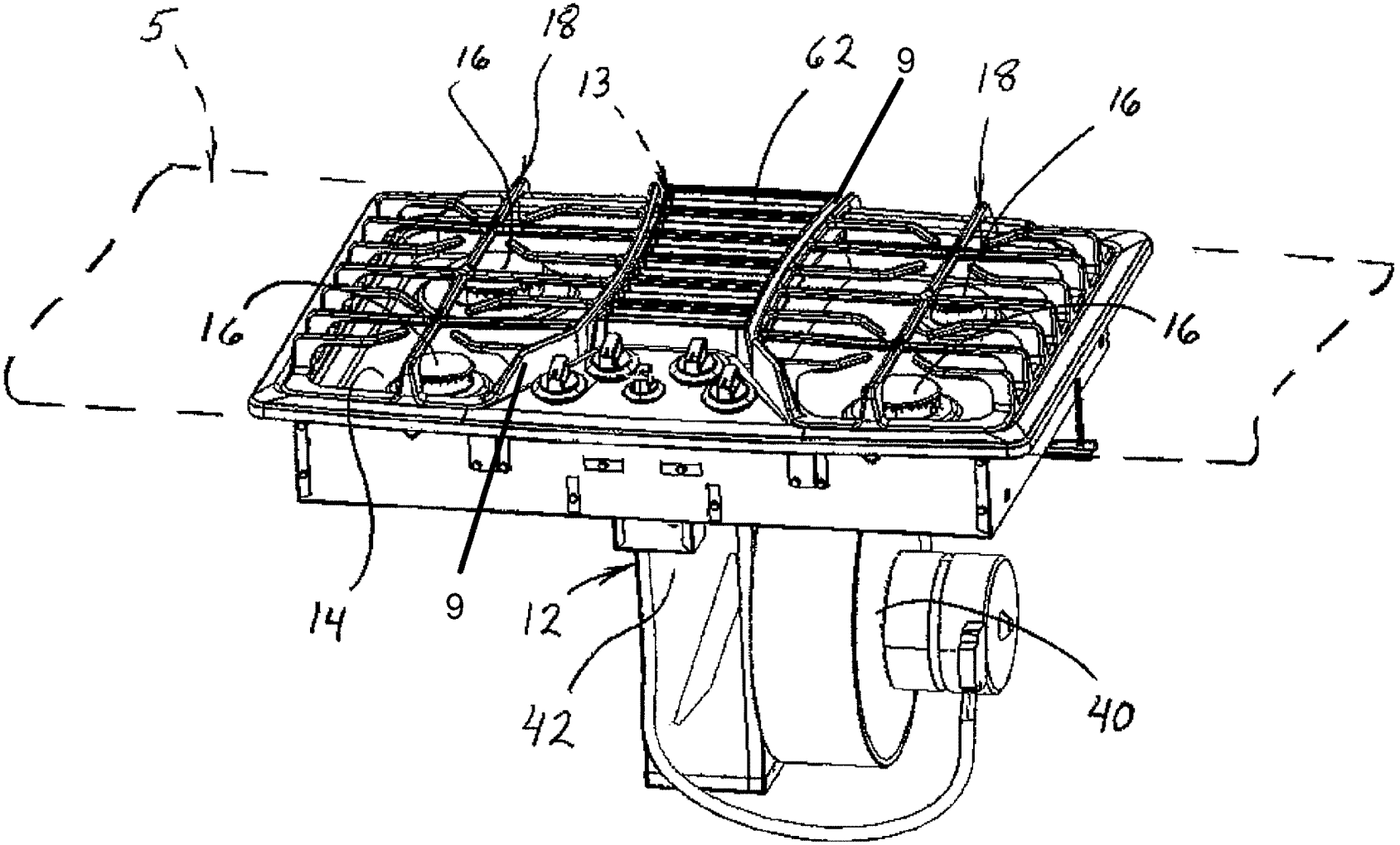
FIG. 1 is a pictorial view of a cooktop having a downdraft ventilator in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto, are often used. They are not limited to direct connection but include connection through other elements where such connection is recognized as being equivalent by those skilled in the art.

DESCRIPTION OF PREFERRED EMBODIMENTS

The cooktop with downdraft ventilator of the present invention generally includes an interconnected panel, plenum, and vent grate that are arranged in a layered and sealed configuration that is substantially airtight. The cooktop may be a gas cooktop but the invention is applicable to any cooktop. The cooktop may also include a panel for supporting multiple burners and that has an upper surface and an opposing lower surface. The panel may have a vent opening that extends through the panel. A vent grate extends away from the upper surface of the panel. The vent grate is aligned with the vent opening allowing cooking fumes to be directed through the vent grate and the vent opening. The vent grate includes an upper wall having openings through which the cooking fumes can flow. The vent grate also includes a side wall that extends downwardly from the vent grate upper wall. A plenum extends away from the lower surface of the panel. The plenum is aligned with the vent opening. A seal arrangement is provided between the panel and the vent grate and the panel and the plenum. This allows the upper and lower surfaces of the panel to be sealed against the vent grate and plenum, respectively. A retention tab incorporated into the seal between the vent grate and the plenum may be fastened to the plenum, ensuring a precise location of the seal.

Nontraditional manufacturing methods may also be employed when manufacturing the cooktop components.

Soft tooling may be used to lower tooling costs and deliver quality parts with lower than typical lead times.

The inventive cooktop with downdraft ventilator is generally shown in FIGS. 1-14. The construction of such a cooktop with burners is well known to those skilled in the art and therefore a detailed description thereof is not necessary to fully understand the present invention which is directed to novel improvements in the construction of the cooktop and its venting system.

Figure 1A:
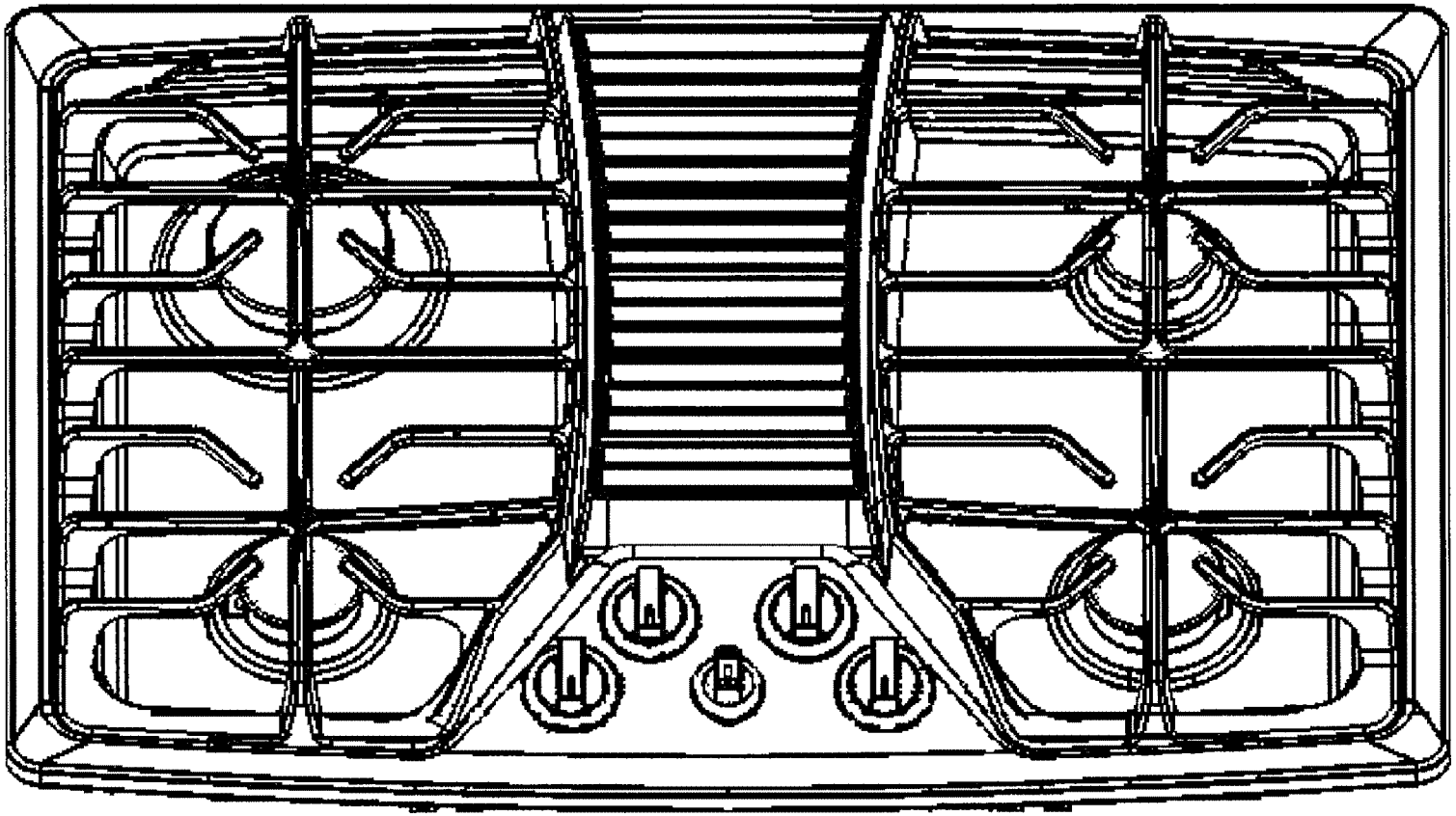
FIG. 1*a* is pictorial view from the front of the cooktop of FIG. 1.

Referring to the drawings, it can be seen that FIGS. 1, 1*a*, 1*b*, and 2 illustrate work surfaces 5 in which cooktops 10 with downdraft ventilators 12 according to the invention are mounted. As is explained in greater detail elsewhere herein, seal arrangements 13 and 19 are provided between various components of the cooktops 10 and ventilators 12. The seal arrangements 13 and 19 are configured as to establish substantially airtight interfaces at such component interconnections between the ventilators 12 and cooktops 10. The cooktops 10 are illustrated as being gas cooktops 10. It is understood that the ventilator 12 may instead be used with a non-gas cooktop such as induction or other electric cooktop. FIGS. 1 and 1*a* illustrate an air flow channel 9 located on both sides of a vent grate 62 that assists in properly directing air flow from the cooking area.

Figure 1B:
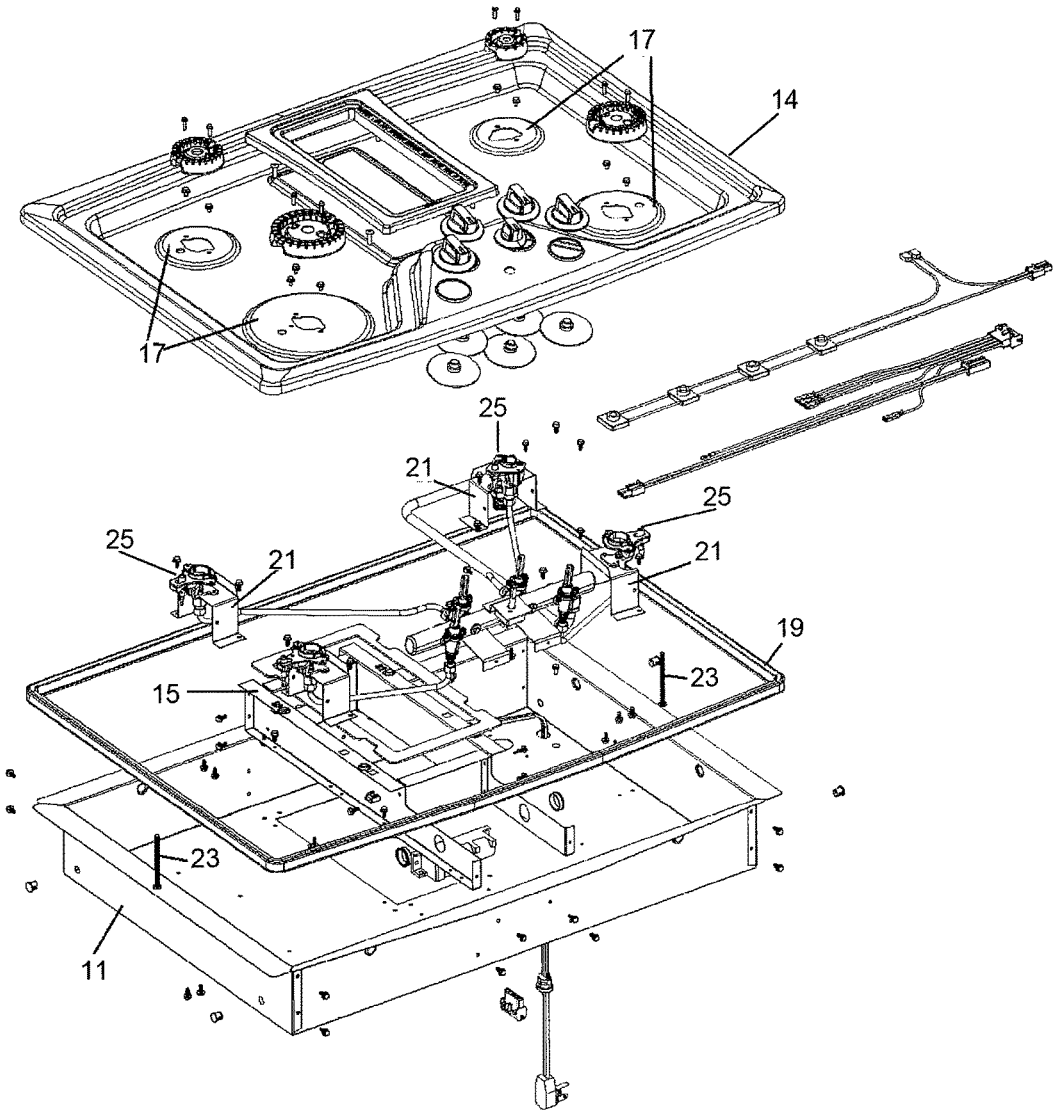
FIG. 1*b* is an exploded view of the cooktop internal components.

Looking now to FIG. 1*b*, an exploded view of an exemplary cooktop can be seen. A burner box 11 generally encloses the internal components of the cooktop assembly. Rails 15 attach and seal to the burner box 11 to provide structural support to the downdraft components of FIGS. 5-10. Burner seats 17 provide structural support for the burners 16 and burner grates 18 of FIGS. 1-2. A burner box seal 19, which may be a die cut extrusion, seals the connection between the burner box 11 and the panel 14. Burner valve brackets 21 support the burner valves 25 and attach them to the burner box 11. Weld studs 23 provide versatility and rigid installation of the burner box 11 into kitchen cabinetry or a countertop by allowing installation either above or below the countertop.

Figure 2:
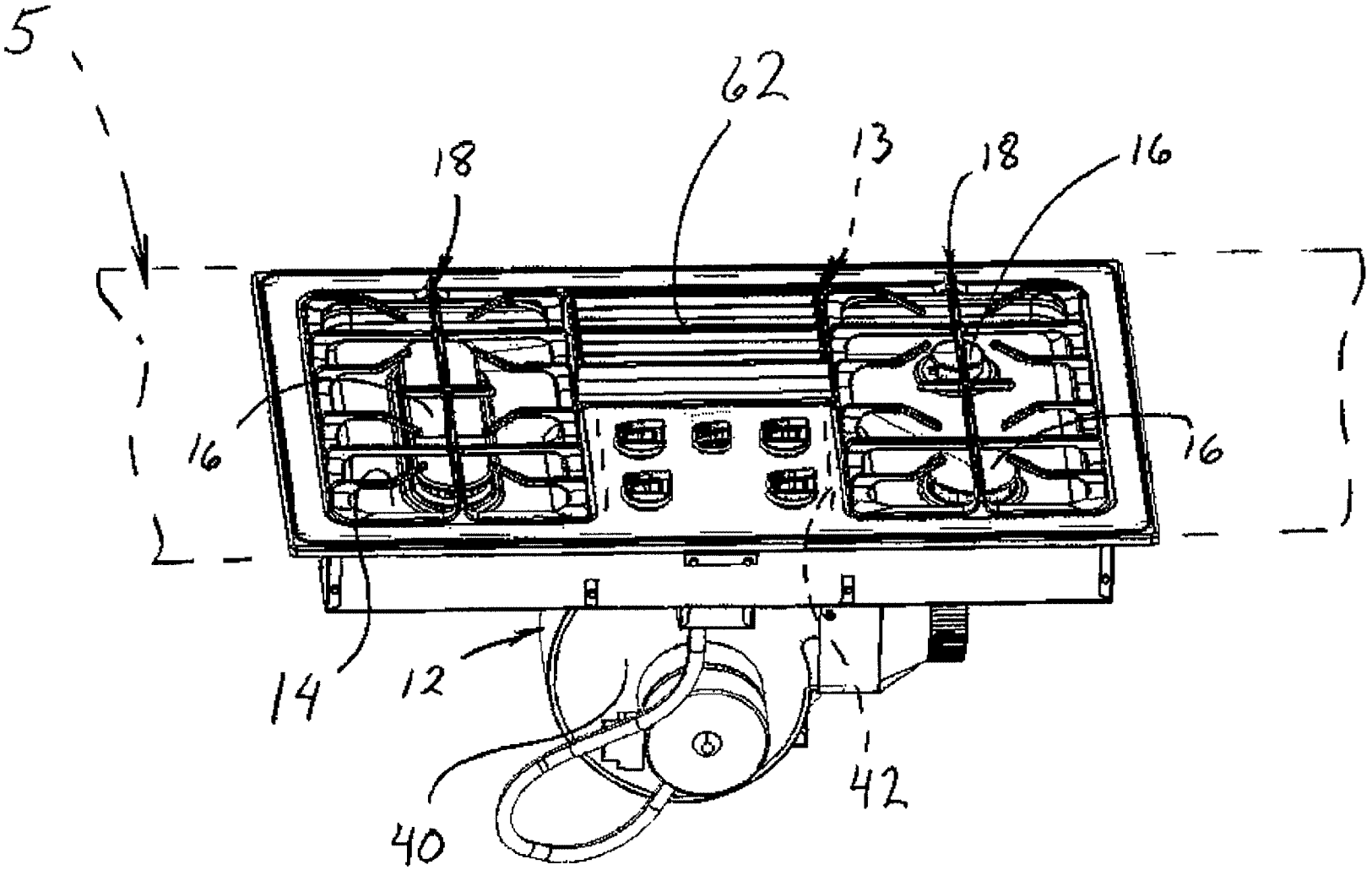
FIG. 2 is a pictorial view of a variant of the cooktop and downdraft ventilator of FIG. 1.
Figure 3:
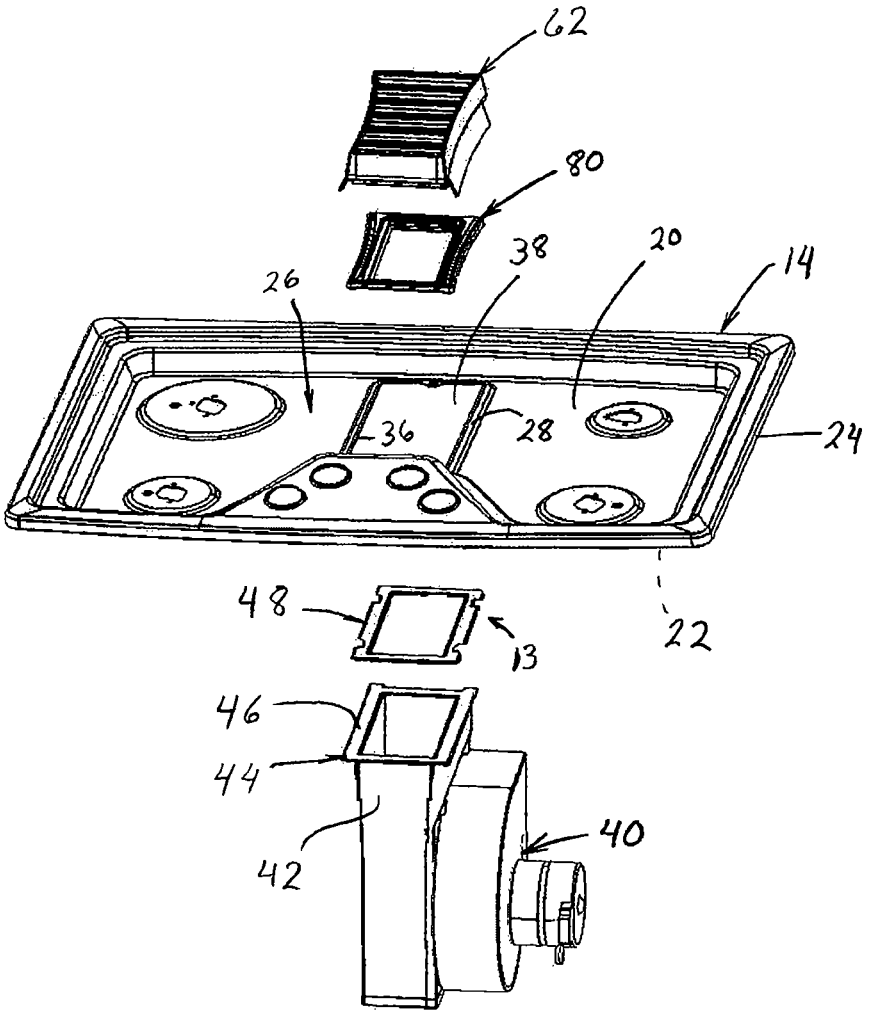
FIG. 3 is an exploded view of portions of the cooktop and downdraft ventilator of FIG. 1.
Figure 4:
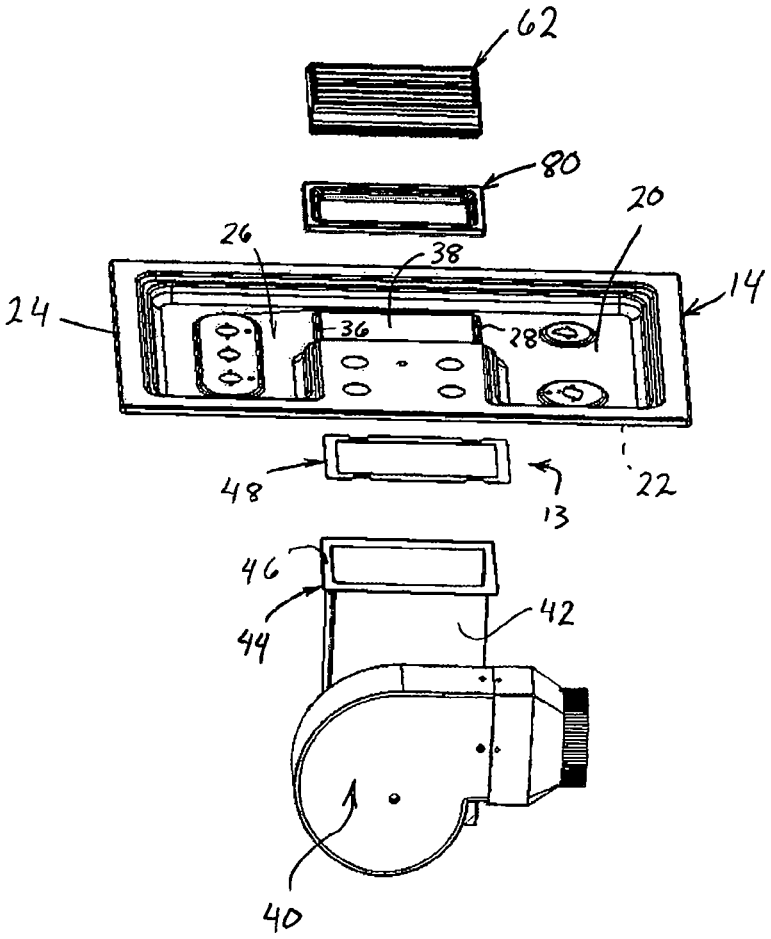
FIG. 4 is an exploded view of portions of the cooktop and downdraft ventilator of FIG. 2.
Figure 5:
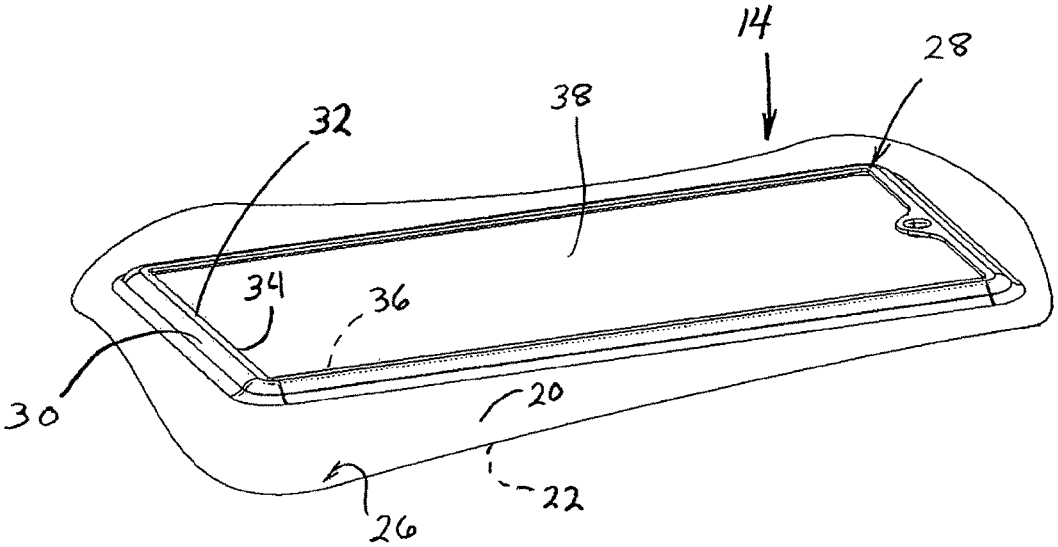
FIG. 5 is a close-up pictorial view of a portion of a panel of the cooktop of FIG. 1.

Referring now to FIGS. 1 and 2, ventilator 12 is mounted to a panel 14 that supports multiple burners, shown here as gas burners 16. The panel may be embossed at all locations where a fastener is used. Embossing prevents over- and under-tightening of the respective fastener during installation and assembly of the cooktop. Burner grates 18 are supported by the panel 14 and extend over the burners 16. Referring now to FIGS. 3 and 4, panel 14 has opposing upper and lower surfaces 20, 22. An outer perimeter 24 extends about the outer periphery of a main portion 26 of the panel 14. A raised shelf 28 extends upwardly from an intermediate location of the panel main portion 26. As shown in FIG. 5, the raised shelf 28 includes angled wall 30 that extends angularly upward from the panel upper surface 20. An upper wall 32 of the raised shelf 28 extends inwardly from an outer segment of the angled wall 30. The upper wall 32 of the raised shelf 28 is generally parallel to the panel upper surface 20. The raised shelf 28 includes an edge 34 that defines a vent perimeter 36. A vent opening 38 extends through the vent perimeter 36 and thus the panel 14.

Referring again to FIGS. 3 and 4, ventilator 12 includes a fan 40 that creates an exhaust airflow which draws cooking fumes away from the space above the panel 14. The exhaust airflow moves the cooking fumes from the fan 40 to a relatively less objectionable exhaust location in a known manner. A plenum 42 extends away from the panel lower surface 22. The plenum 42 interconnects the fan 40 and the panel 14. The plenum 42 has an opening that is aligned with the vent opening 38. In this way, cooking fumes that are drawn through the vent opening 38 are directed through the plenum 42, to the fan 40, and then exhausted to a suitable location. A flange 44 extends peripherally out from an upper end of the plenum 42. The plenum flange 44 defines a flat upper surface 46 that is rectangular in profile shape. The plenum flange upper surface 46 faces toward the panel lower surface 22. Further, the plenum flange 44 may be arranged entirely outside of the raised shelf 28.

Figure 11:
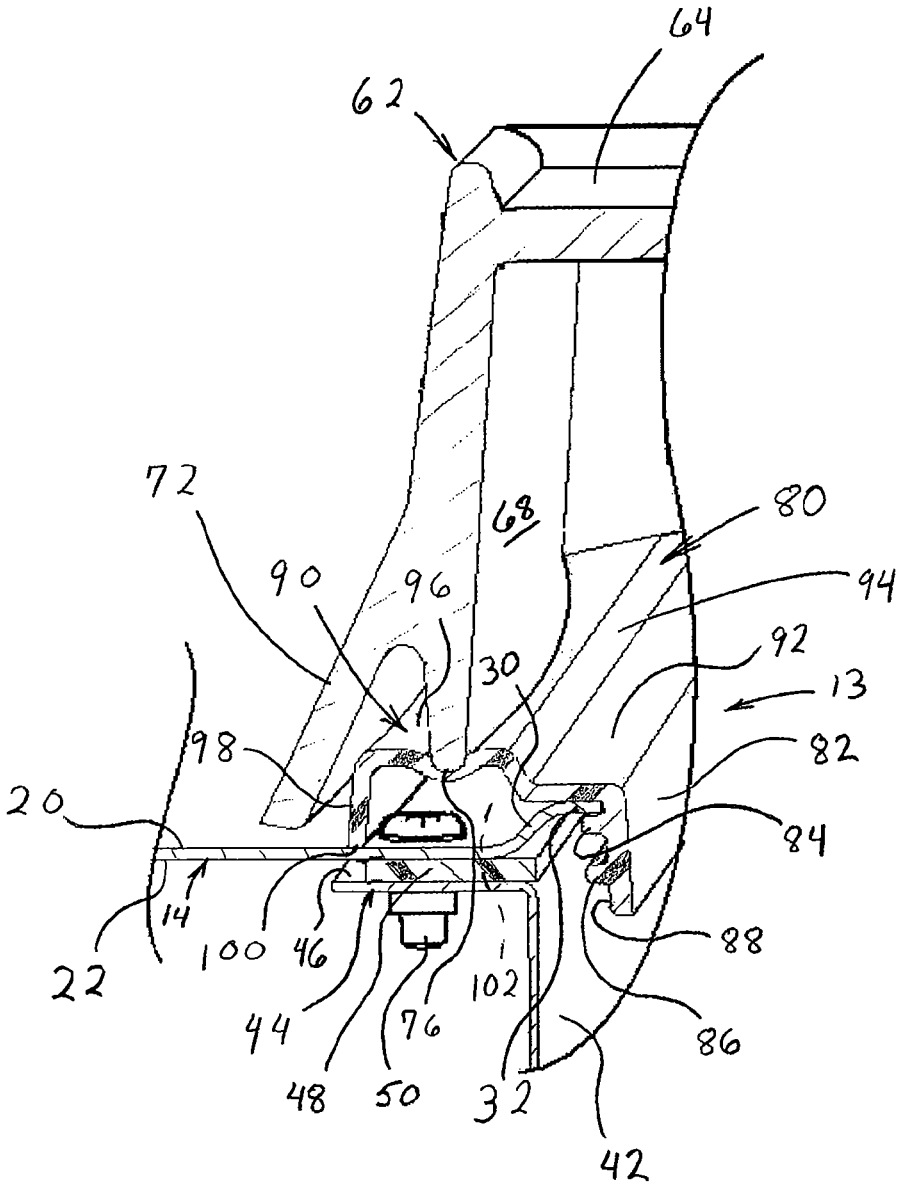
FIG. 11 is partial cross-sectional view of a portion of the cooktop of FIG. 1.
Figure 12:
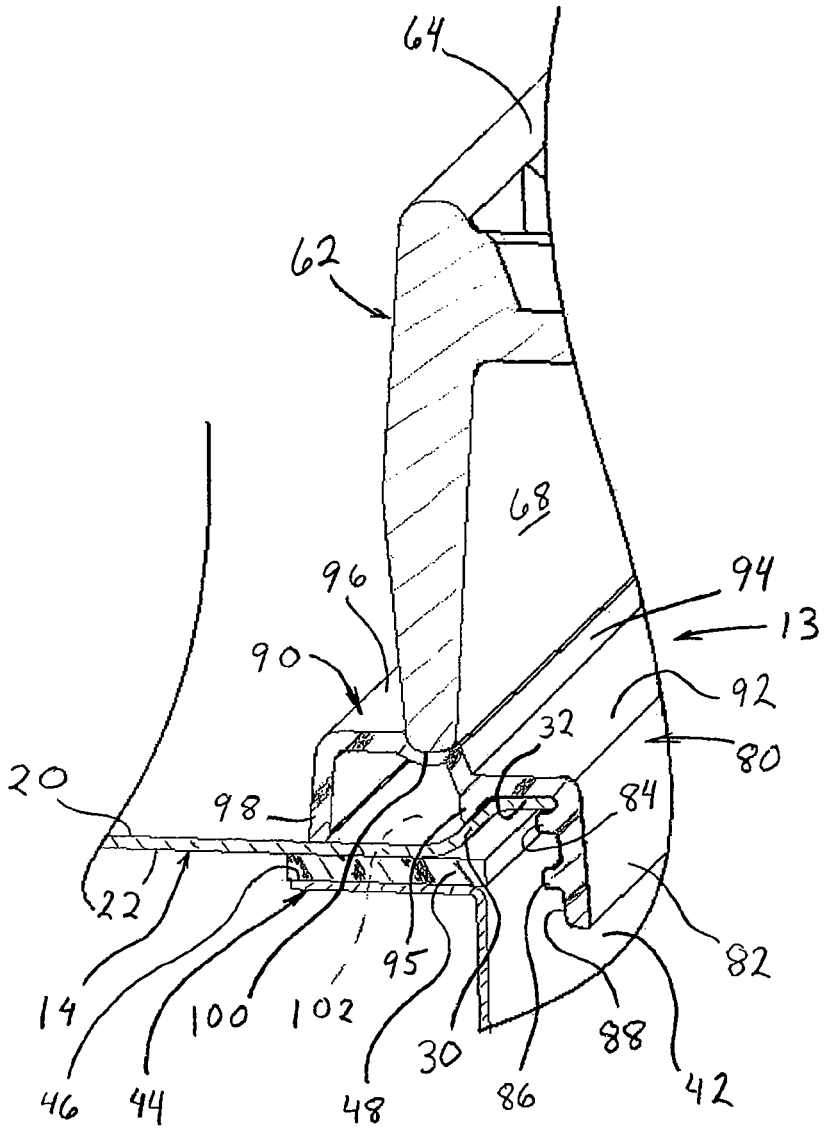
FIG. 12 is partial cross-sectional view of a portion of the cooktop of FIG. 2.

As shown in FIGS. 11 and 12, in these embodiments, an inner-most portion of the plenum flange 44 extends slightly below the raised shelf 28. The plenum flange 44 projects about half-way across the length of the raised shelf angled wall 30. Regardless, the plenum flange 44 extends sufficiently across part of the panel lower surface 22 of the main to be sealed against it by way of the seal arrangement 13.

Referring now to FIGS. 3 and 4, seal arrangement 13 includes a plenum seal 48. Plenum seal 48 serves as a gasket between the flat surfaces of the panel lower surface 22 and the plenum flange upper surface 46. Referring again to FIGS. 11 and 12, the plenum seal 48 is sufficiently thick and resilient or deformable to accommodate deviations of the panel lower surface 22 and the plenum flange upper surface 46 from being truly flat. In this way, the plenum seal 48 conforms to irregularities and substantially fills void spaces between the panel lower surface 22 and the plenum flange upper surface 46. Further, as fasteners 50 (FIG. 11) tighten the panel 14 and plenum flange 44 against each other, the plenum seal 48 is sandwiched or compressed and fills any void space therebetween. The fasteners 50 may include any fastening device in the art; however, the preferred fastener is a screw and a square-shaped trimmer nut combination. The fasteners 50 make the layered interconnection of the plenum 42, plenum seal 48, and panel 14, substantially airtight.

Figure 6:
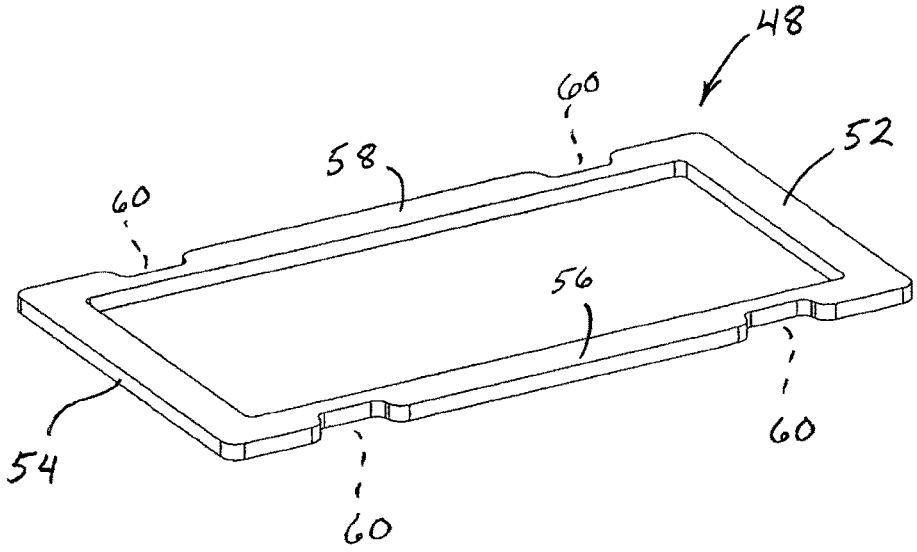
FIG. 6 is a close-up pictorial view of a plenum seal according to the present invention.

Referring now to FIG. 6, plenum seal 48 has a substantially rectangular perimeter shape. Opposing end segments 52, 54 are interconnected at their ends by opposing side segments 56, 58. Cutaways 60 that are spaced from each other extend into the side segments 56, 58. The cutaways 60 align with holes (not shown) in the panel 14 and plenum flange 44 through which the fasteners 50 extend (FIG. 11). In this way, multiple fasteners 50 clamp the panel 14 and plenum flange 44 to each other at multiple spaced apart locations about the vent opening 38. The fasteners 50 do not extend through the plenum seal 48, per se, but instead extend outwardly of the plenum seal 48 by way of passing through the cutaways 60.

Referring again to FIGS. 3 and 4, the ventilator 12 further includes a vent grate 62. Each vent grate 62 has a perimeter shape that corresponds to the perimeter shapes of the burner grates 18 being used with a particular cooktop 10. The burner grates 18 of FIGS. 1 and 3 have arcuate inwardly facing segments, such that the vent grate 62 has corresponding arcuate outwardly facing segments in its perimeter shape. The burner grates 18 of FIGS. 2 and 4 have straight inwardly facing segments, such that the vent grate 62 has corresponding straight outwardly facing segments in its perimeter shape.

Referring now to FIGS. 7-10, each vent grate 62 includes a top wall 64 that has openings 65 extending therethrough. The openings 65 are defined between adjacent louvers 66. The louvers 66 are generally flat and arranged nearly upright or vertical. However, the louvers 66 are angled or tipped downwardly from being truly vertical, toward operator controls on the cooktop 10 (FIGS. 1 and 2). This arrangement allows the ventilator 12 to pull air through the vent grate 62 from a generally central location above the panel 14. Each vent grate 62 has multiple interconnected side walls 68. The side walls 68 extend downwardly from the outer perimeter of the top wall 64. Multiple feet 70 extend downwardly from each of the vent grates 62, away from the top wall 64. The feet 70 are spaced about a periphery of the vent grates 62 and are set upwardly or recessed with respect to a lowermost portion of the vent grates 62. The feet 70 are preferably made from a resilient material and sit directly upon the panel 14 to support the vent grates 62.

Figure 7:
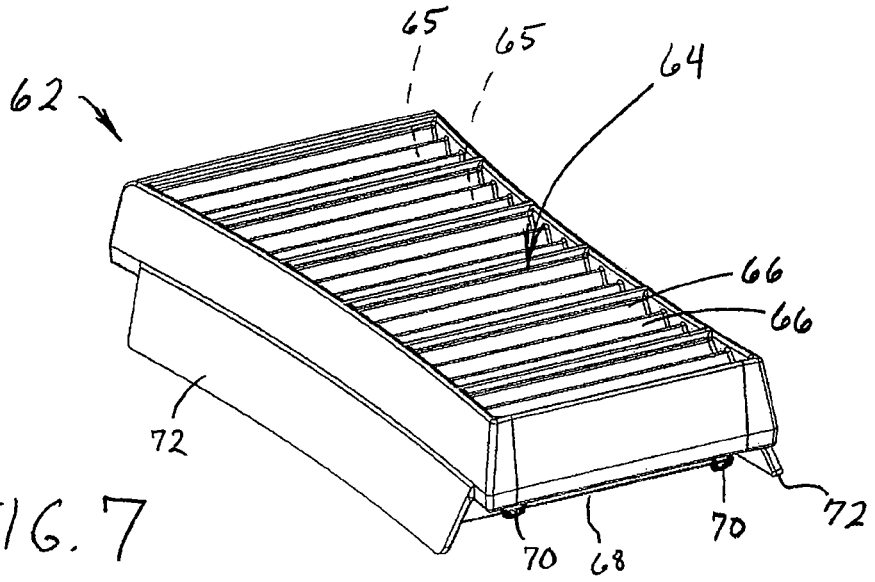
FIG. 7 is a pictorial view from above of the vent grate of FIG. 1.
Figure 8:
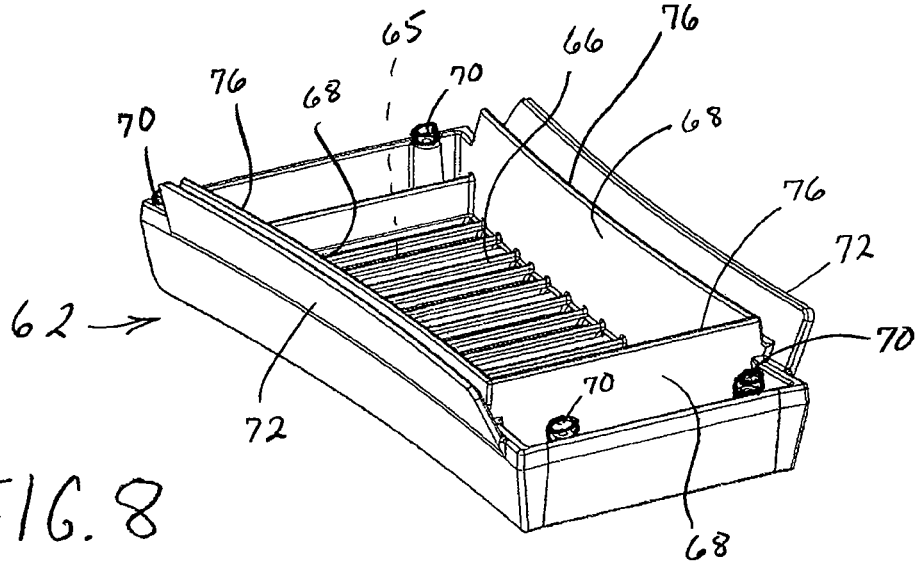
FIG. 8 is a pictorial view from below of the vent grate of FIG. 1.
Figure 9:
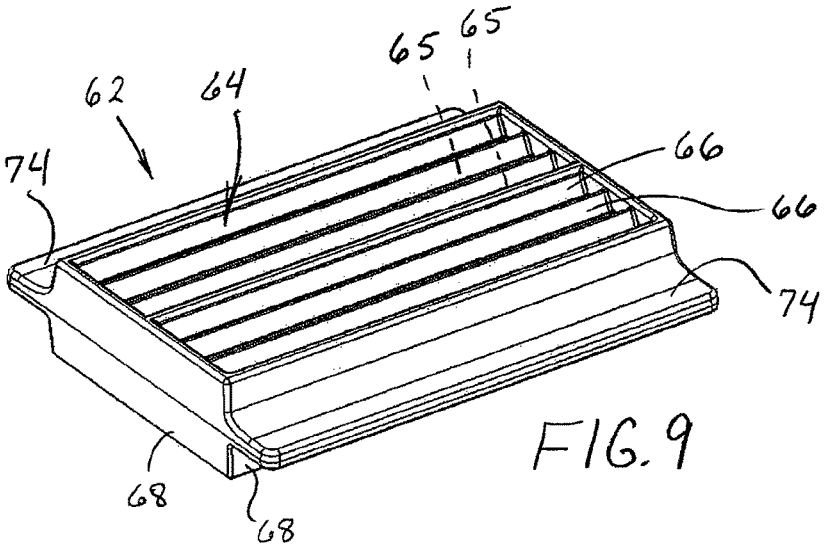
FIG. 9 is a pictorial view from above of the vent grate of FIG. 2.

The embodiment of FIGS. 7 and 8 further includes lower walls 72. The lower walls 72 extend angularly from the longer pair of side walls 68 of that embodiment. Lower walls 72 intersect the respective side walls 68 at an outer surface thereof, about one quarter of the way up from the bottom of the side walls 68. The embodiment of FIGS. 9 and 10 further includes outer flanges 74. The outer flanges 74 extend generally orthogonally away from middle portions of respective side walls 68. The outer flanges 74 support the feet 70 of this embodiment.

Figure 10:
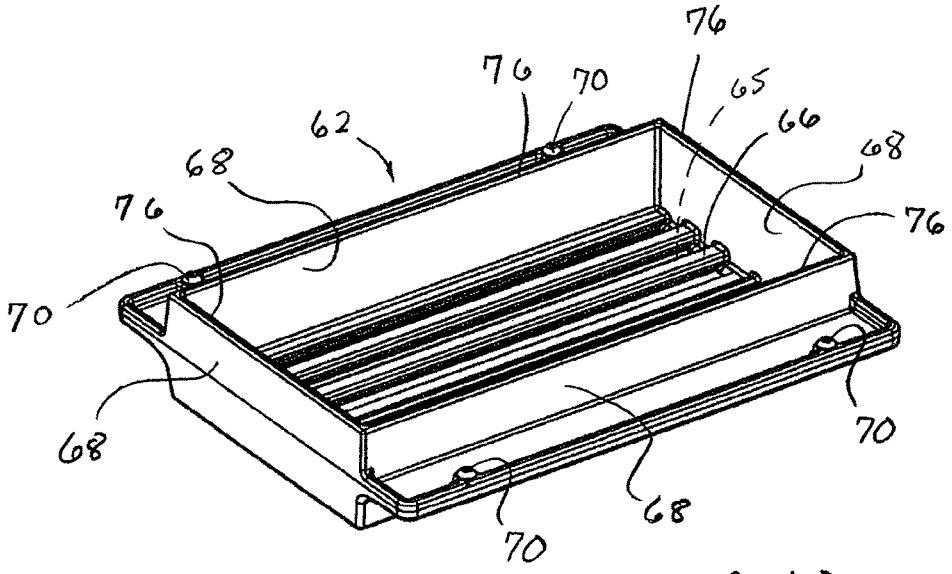
FIG. 10 is a pictorial view from below of the vent grate of FIG. 2.

Referring now to FIGS. 8 and 10, regardless of the particular configuration of the vent grate 62, lower edges 76 are defined at the bottoms of the side walls 68. In the embodiment of FIG. 8, the lower edges 76 define a U-shaped profile, with three side walls 68 extending downwardly to a common height. In the embodiment of FIG. 10, the lower edges 76 extend continuously about a rectangular lower perimeter shape. The lower edges 76 are configured to engage a vent seal 80 that is part of the seal arrangement 13.

Referring again to FIGS. 3 and 4, vent seal 80 is provided between the panel 14 and the vent grate 62. The vent seal 80 is sufficiently thick and resilient or deformable to accommodate deviations of the panel upper surface 20 and the vent grate side wall lower edges 76 from being truly flat. In this way, the vent seal 80 conforms to irregularities and substantially fills void spaces between the panel upper surface 20 and the vent grate side wall lower edges 76. Moreover, the weight of the vent grate 62 that pushes against the vent seal 80 allows the vent seal 80 to be sandwiched or compressed and to fill any void space between the panel 14 and vent grate 62. This makes the layered interconnection of the vent grate 62, vent seal 80, and panel 14, substantially airtight.

Referring again to FIGS. 11 and 12, vent seal 80 includes an inner collar 82 that extends vertically or downwardly with respect the remainder of the vent seal 80. Inner collar 82 extends into the vent opening 38, so that the inner collar 82 nests inside of an upper portion of the plenum 42. A rib or, as shown, a pair of ribs 84, 86 extends outwardly from an outer surface 88 of the inner collar 82. The ribs 84, 86 are spaced from each other vertically or along the length of the inner collar 82. In one embodiment, the ribs 84, 86 extend continuously about the entire perimeter of the inner collar 82. In another embodiment, multiple discrete sets of ribs 84, 86 extend along less than the entire perimeter of the inner collar 82. In one such exemplary embodiment four sets of ribs 84, 86 are provided that wrap around the four corners of the inner collar 82, whereas the majority of the outer surface 88 of the inner collar 82 is flat or without ribs 84, 86.

Still referring to FIGS. 11 and 12, the vent seal 80 includes an upper wall 90 that extends generally orthogonally away from the vent opening 38. Vent seal upper wall 90 includes an inner segment 92 that connects to the inner collar 82. An angled segment 94 connects to the inner segment 92. The angled segment 94 extends angularly upwardly and outwardly away from the inner segment 92. In the embodiment of FIG. 12, a leg 95 extends downwardly at an angle, away from the intersection of the inner and angled segments 92, 94 of the vent seal upper wall 90. Referring again to both FIGS. 11 and 12, an outer segment 96 of the vent seal upper wall 90 connects to and extends away from the angled segment 94. The outer segment 96 of the vent seal upper wall 90 is spaced from the panel 14. In a resting state in which the vent grate 62 is not mounted to the cooktop 10, the outer segment 96 of the vent seal upper wall 90 is substantially horizontal and parallel to the panel 14. A side wall 98 extends generally orthogonally or vertically between the outer segment 96 of the vent seal upper wall 90 and the panel upper surface 20. A bottom edge 100 of side wall 98 engages the upper surface 20 of the panel 14.

Still referring to FIGS. 11 and 12, in the complete assemblage, the vent seal 80 engages the panel 14 at multiple locations and also engages the plenum 42 and vent grate 62. As mentioned elsewhere, the vent seal inner collar 82 is nested within the plenum 42. The lower rib 86 of the vent seal inner collar 82 may engage an inwardly facing surface of the plenum 42. The upper wall 32 of the panel raised shelf 28 fits snugly between an upper surface of the upper rib 84 and a lower surface of the inner segment 92 of the vent seal upper wall 90. In the embodiment of FIG. 12, the leg 95 of the vent seal 80 engages an upper surface of the raised shelf angled wall 30 of the panel 14. Referring again to FIGS. 11 and 12, of the vent seal 80, the upper wall angled and outer segments 94, 96 and the side wall 98 generally define an upside-down U-shaped perimeter of a void space 102 below.

Figure 13:
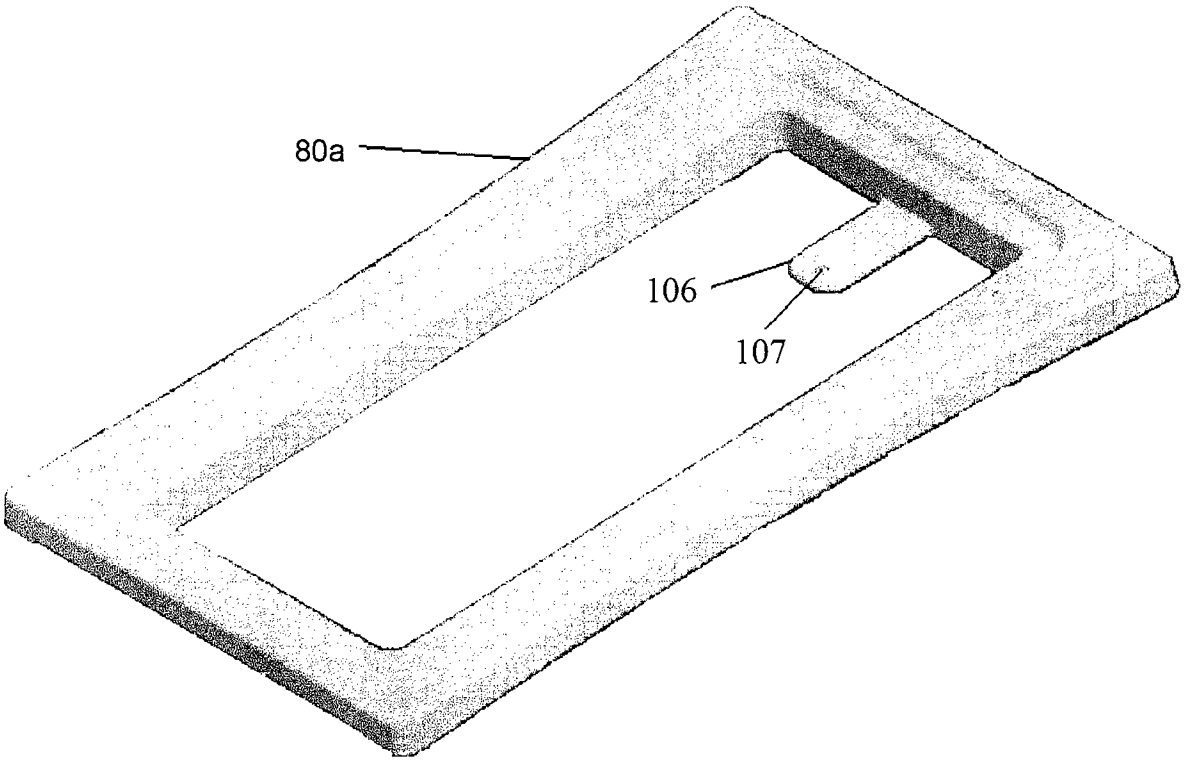
FIG. 13 is an isometric view of an alternative embodiment of the vent seal of FIG. 3.
Figure 14:
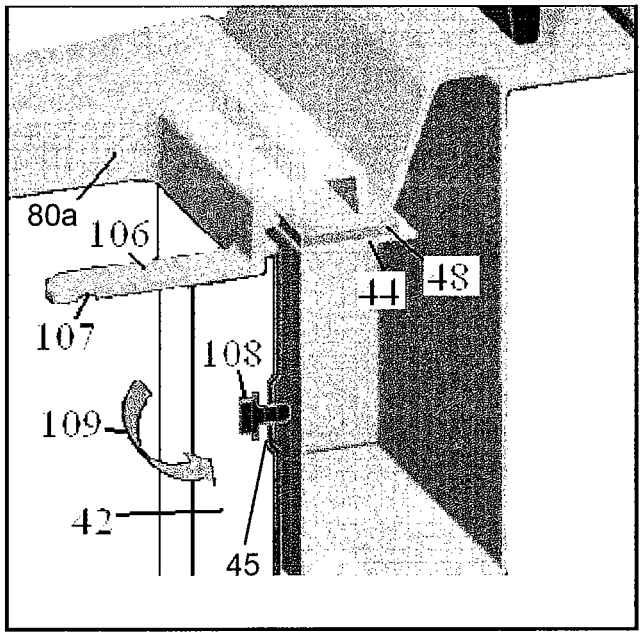
FIG. 14 is a partial cross-sectional view of an alternative embodiment of a portion of the cooktop according to FIG. 2.

Looking now to FIG. 13, an alternative embodiment of the vent seal 80 is shown. The alternative vent seal **80*a* includes a mounting tab 106 with a mounting tab hole 107. An appropriate fastener may be inserted through the mounting tab hole 107 to provide a safeguard in holding the vent seal 80*a* in place. Such a configuration is demonstrated in FIG. 14, where the alternative vent seal 80*a* is installed in a similar fashion as the vent seal 80 of FIG. 12. Referring back to FIG. 14, a fastener, such as a mounting tab screw 108, may be affixed in the plenum 42. The plenum may include an embossing 45 in the area that the mounting tab screw is affixed to add structural rigidity to the plenum 42. The mounting tab 106 is bent so that it is flush with the plenum 42 in the direction as indicated by arrow 109. The mounting tab screw is placed through the mounting tab hole 107 and through the plenum 42 wall, affixing the mounting tab 106 flush against the plenum 42**.

Now transitioning to FIG. 11, the void space 102 provides enough room to house a head of the fastener 50 therein and allow the vent seal upper wall 90 to flex downwardly when the weight of the vent grate 62 pushes it down. Accordingly, the vent seal upper wall 90 defines two positions or heights with respect to the panel 14, depending on whether or not the vent seal upper wall 90 is being engaged by the vent grate 62. A first height with respect to the upper surface 20 of the panel 14 is defined when the vent grate 62 is removed from the cooktop 10. In such instance, the vent grate 62 does not engage the vent seal 80 and the upper wall outer segment 96 extends substantially horizontally, defining a constant height across its length. A second height with respect to the upper surface 20 of the panel 14 is defined when the vent grate 62 is mounted to the cooktop 10. The second height is lower or shorter than the first height. In such instance, the second height is defined when the vent grate 62 engages the vent seal 80 so that part of the upper wall outer segment 96 is pushed down by the weight of the vent grate 62 as transmitted through the lower edges 76 of the vent grate side walls 68. The weight of the vent grate 62 is great enough to substantially push the vent seal upper wall outer segment 96 toward the panel 14. The extent to which the vent seal upper wall outer segment 96 is pushed down is limited or defined by the space between the lower edges 76 of the vent grate side walls 68 when the feet 70 are sitting upon the panel 14, supporting the vent grate 62.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A gas cooktop comprising:

a panel having an upper surface and an opposing lower surface and an outer perimeter, the panel having a vent opening that is provided inwardly of the outer perimeter of the panel and that extends through the panel so as to define a vent perimeter extending about the vent opening;

multiple gas burners for providing cooking flames at spaced-apart locations above the upper surface of the panel and between the outer perimeter of the panel and the vent perimeter;

a vent grate that extends away from the upper surface of the panel and is aligned with the vent opening so that cooking fumes that are created during a cooking process can be directed through the vent grate and the vent opening to exhaust the cooking fumes away from the panel;

a plenum that extends away from the lower surface of the panel and is aligned with the vent opening so that the cooking fumes are drawn through the vent grate and vent opening and directed through the plenum;

a plenum seal that is arranged between an upper end of the plenum and the lower surface of the panel; and a vent seal that is arranged between the upper surface of the panel and the vent grate, the vent seal comprising:

an inner collar extending downwardly into the vent opening;

an upper wall extending orthogonally away from the vent opening, the upper wall including an inner segment connected to the inner collar, an angled segment connected to the inner segment and extending angularly upwardly and outwardly from the inner segment, and an outer segment connected to and extending away from the angled segment; and a side wall extending between the upper wall and the upper surface of the panel so as to hold the upper wall in a position that is spaced from the upper surface of the panel;

wherein the vent grate engages the outer segment of the upper wall of the vent seal.

2. The gas cooktop of claim 1, wherein the plenum includes a flange that extends outwardly from the upper end thereof and the plenum seal is substantially flat and is sandwiched between the flange of the plenum and the lower surface of the panel, and wherein multiple fasteners extend between and draw the flange of the plenum and the panel toward each other to compress the plenum seal between the flange of the plenum and the lower surface of the panel.

3. The gas cooktop of claim 1, wherein the panel defines a main portion and a raised shelf that extends about the vent opening, the raised shelf including an edge that defines the vent perimeter.

4. The gas cooktop of claim 3 wherein the vent seal further comprises a leg extending downward from the upper wall to engage an upper surface of the raised shelf.

5. The gas cooktop of claim 4 wherein the leg extends downward from the upper wall at a location adjacent the angled segment extending from the inner segment.

6. The gas cooktop of claim 3, wherein the raised shelf of the panel includes an angled wall that extends angularly from the main portion of the panel and an upper wall that extends from the angled wall of the raised shelf, the edge of the raised shelf being defined at an end of the upper wall.

7. The gas cooktop of claim 6, wherein the upper wall of the raised shelf is generally parallel to the main portion of the panel.

8. The gas cooktop of claim 1, wherein the inner collar extends downwardly into the vent opening in a direction that is generally parallel to the plenum.

9. The gas cooktop of claim 1, wherein the inner collar of the vent seal extends downwardly beyond the remainder of the vent seal and is nested inside of an upper portion of the plenum.

10. The gas cooktop of claim 9, wherein a rib extends outwardly from the inner collar of the vent seal in a direction that faces toward the outer perimeter of the panel.

11. The gas cooktop of claim 10, wherein the rib defines a first rib upon the inner collar; and wherein a second rib extends from the inner collar in a direction that faces toward the outer perimeter of the panel, the first and second ribs being parallel to and spaced from each other along the inner collar.

12. The gas cooktop of claim 10, wherein a portion of the panel through which the vent opening extends is held within a space that is between the rib of the vent seal and the inner segment of an upper wall of the vent seal.

13. The gas cooktop of claim 12, wherein the panel defines a main portion and a raised shelf that extends about the vent opening, at least a portion of the raised shelf of the panel extending into the space between the rib and the inner segment of the upper wall of the vent seal.

14. The gas cooktop of claim 1, wherein the vent grate engages the upper wall of the vent seal.

15. The gas cooktop of claim 1, the vent grate further comprising a side wall that engages the upper wall of the vent seal and a lower wall that extends from the vent grate side wall and outwardly beyond the vent seal.

16. The gas cooktop of claim 15, wherein the vent grate lower wall extends angularly downwardly and outwardly from an outer surface of the vent grate side wall.

17. The gas cooktop of claim 1 wherein the outer segment of the vent seal flexes from a first height to a second height when engaged with the vent grate, wherein the first height is greater than the second height.

18. A gas cooktop comprising:

a panel for supporting multiple gas burners and having an upper surface and an opposing lower surface, the panel having a vent opening that extends through the panel;

a vent grate that extends away from the upper surface of the panel and is aligned with the vent opening so that cooking fumes that are created during a cooking process can be directed through the vent grate and the vent opening to exhaust the cooking fumes away from the panel, the vent grate including an upper wall having openings through which the cooking fumes can flow and a side wall that extends downwardly from the vent grate upper wall; and a vent seal that is arranged between the upper surface of the panel and the vent grate, the vent seal including:

an inner collar that extends downwardly through the vent opening;

an upper wall that engages the vent grate side wall, the upper wall including an inner segment connected to the inner collar, an angled segment connected to the inner segment and extending from the inner segment, and an outer segment connected to and extending from the angled segment; and a side wall that extends between the outer segment and the upper surface of the panel so as to hold the upper wall in a position that is spaced from the upper surface of the panel;

wherein the outer segment is elevated with respect to the inner segment; wherein the vent grate engages the outer segment of the upper wall of the vent seal.

19. The gas cooktop of claim 18, wherein the gas cooktop further comprises:

a plenum attached to the vent seal and aligned with the vent opening so that the cooking fumes can be directed through the vent grate, through the vent opening, and through the plenum;

a retaining tab attached to the vent seal;

wherein the retaining tab is attached to the plenum with a fastener.

20. The gas cooktop of claim 18, wherein engagement of the vent grate side wall and vent seal upper wall pushes the vent seal upper wall relatively closer to the upper surface of the panel, such that the vent seal upper wall defines (i) a first height with respect to the upper surface of the panel when the vent grate is removed from the gas cooktop and (ii) a second height with respect to the upper surface of the panel that is shorter that the first height when the vent grate is mounted to the gas cooktop.

21. A cooktop comprising:

a panel for supporting multiple burners and having an upper surface and an opposing lower surface, the panel having a vent opening that extends through the panel;

a vent grate that extends away from the upper surface of the panel and is aligned with the vent opening so that cooking fumes that are created during a cooking process can be directed through the vent grate and the vent opening to exhaust the cooking fumes away from the panel, the vent grate including an upper wall having openings through which the cooking fumes can flow and a side wall that extends downwardly from the vent grate upper wall;

a plenum that extends away from the lower surface of the panel and is aligned with the vent opening so that the cooking fumes that are drawn through the vent grate and vent opening are directed through the plenum; and a seal arrangement comprising a vent seal provided between the panel and the vent grate and a plenum seal provided between the panel and an upper end of the plenum such that the upper and lower surfaces of the panel are sealed against the vent grate and plenum, respectively;

wherein the vent seal comprises:

an inner collar extending downwardly into the vent opening;

an upper wall extending orthogonally away from the vent opening, the upper wall including an inner segment connected to the inner collar, an angled segment connected to the inner segment and extending angularly upwardly and outwardly from the inner segment, and an outer segment connected to and extending away from the angled segment; and a side wall extending between the upper wall and the upper surface of the panel so as to hold the upper wall in a position that is spaced from the upper surface of the panel; wherein the vent grate rests on the outer segment of the upper wall of the vent seal.

22. The cooktop of claim 21 wherein the seal arrangement further comprises a retaining tab attached to the plenum with a fastener.

* * * * *